US006142790A

United States Patent [19]

Niitsu

[11] Patent Number: 6,142,790

[45] Date of Patent: Nov. 7, 2000

[54] CONNECTOR WITH FLEXIBLE BEAM PROVIDING UNIFORM CONTACT PRESSURE

[75] Inventor: Toshihiro Niitsu, Yokohama, Japan

[73] Assignee: Molex Incorporated, Lisle, Ill.

[21] Appl. No.: 09/312,533

[22] Filed: May 14, 1999

[30] Foreign Application Priority Data

Jun. 12, 1998 [JP] Japan ..... 10-181412

[51] Int. Cl.[7] ..... H01R 12/00

[52] U.S. Cl. ..... 439/66; 439/722; 439/862; 439/891; 439/620; 439/495

[58] Field of Search ..... 439/66, 891, 722, 439/67, 70, 862, 630, 620, 627, 495, 188

[56] References Cited

U.S. PATENT DOCUMENTS 2,509,701 5/1950 Smith, Jr. ..... 439/722

4,623,207 11/1986 Sasaki et al. ..... 339/17

*Primary Examiner*—Paula Bradley
*Assistant Examiner*—Truc Nguyen
*Attorney, Agent, or Firm*—Stephen Z. Weiss

[57] ABSTRACT

An electrical connector is provided for interconnecting a pair of generally parallel flat circuits and includes a dielectric housing adapted for mounting on a first flat circuit. A plurality of terminals are mounted on the housing and are spaced therealong. Each terminal includes a base anchored in the housing. A tail extends from one end of the base for connection to an appropriate conductor on the first flat circuit. A cantilevered beam extends from an opposite end of the base and terminates in a U-shaped joint. A contact arm extends from the U-shaped joint back over the cantilevered beam and terminates in a contact portion for engaging an appropriate conductor on a second flat circuit. The cantilevered beam includes a first bowed portion projecting toward the first flat circuit and a second bowed portion projecting toward the second flat circuit.

3 Claims, 4 Drawing Sheets

CONNECTOR WITH FLEXIBLE BEAM PROVIDING UNIFORM CONTACT PRESSURE

FIELD OF THE INVENTION

This invention generally relates to the art of electrical connectors and, particularly, to an electrical connector for interconnecting a pair of generally parallel flat circuits, such as two printed circuit boards, a printed circuit board and a flat flexible cable or the like.

BACKGROUND OF THE INVENTION

It is known to provide electrical connectors for connection to a flat circuit by the use of cantilevered contact arms or beams. Typically, such a connector includes a relatively low profile dielectric housing which mounts a plurality of terminals. The terminals include the cantilevered contact arms or beams for surface engaging appropriate circuit pads on the flat circuit. Opposite ends of the terminals are appropriately connected to the conductors of another connecting device. For instance, the opposite ends of the terminals may comprise tails for connection, as by soldering, to circuit traces on a second flat circuit. Therefore, such connectors can readily interconnect a pair of flat circuits, such as a pair of printed circuit boards or a printed circuit board and a flat flexible cable, for instance.

One of the problems in using cantilevered contact arms or beams is that the beams do not always provide uniform and reliable contact pressure against the circuit pads on the flat circuit. In other words, the resiliency of the beams is not consistent. This typically is due to the fact that stresses are not distributed evenly over the length of the contact arm or beam. This results in inconsistent contact pressures applied by a plurality of beams. The present invention is directed to solving these problems by an improved contact beam structure in the terminals of such electrical connectors.

SUMMARY OF THE INVENTION

An object, therefore, of the invention is to provide a new and improved electrical connector of the character described for connection to a flat circuit and to provide improved resiliency and stress distribution in the terminals of the connector.

In the exemplary embodiment of the invention, the connector includes a generally flat dielectric housing adapted for mounting on a first flat circuit. A plurality of terminals are mounted on the housing and are spaced therealong. Each terminal includes a base anchored in the housing. A tail extends from one end of the base for connection to an appropriate conductor on the first flat circuit. A cantilevered beam extends from an opposite end of the base and terminates in a U-shaped joint. A contact arm extends from the U-shaped joint back over the cantilevered beam and terminates in a contact portion for engaging an appropriate conductor on a second flat circuit. The cantilevered beam includes a first bowed portion projecting toward the first flat circuit and a second bowed portion projecting toward the second flat circuit.

As disclosed herein, at least the bases of the terminals are insert molded in the housing. The second bowed portion follows the first bowed portion sequentially along the cantilevered beam away from the base toward the U-shaped joint of each terminal. Each bowed portion comprises straight lengths of the cantilevered beam meeting at an apex.

It should be understood herein that the invention is not limited to a U-shaped terminal. The stress distribution provided by the cantilevered beam structure of the invention is equally applicable for other types of cantilevered terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 2:
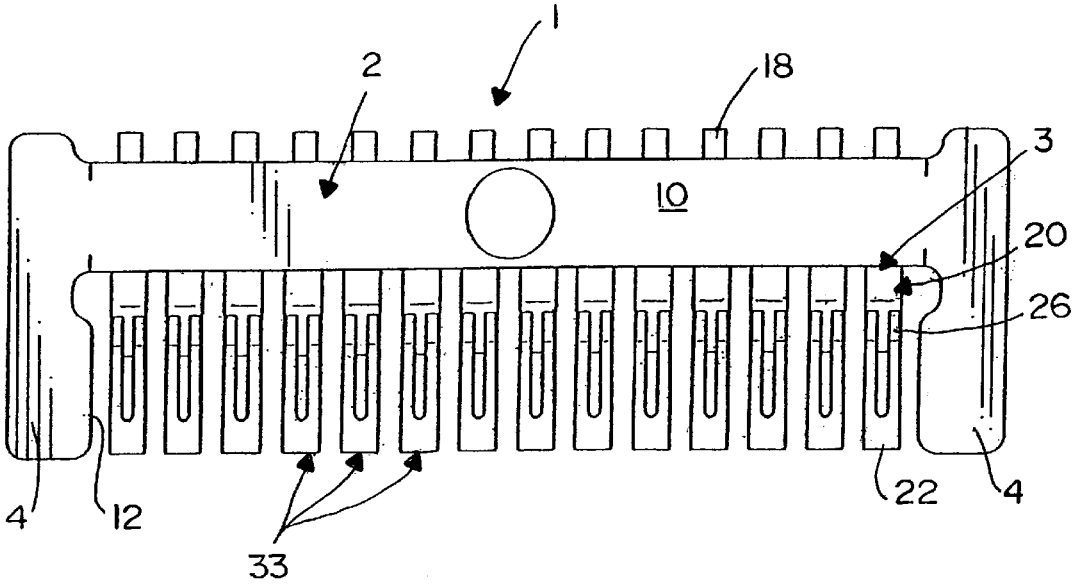
FIG. 2 is a top plan view of the connector.
Figure 3:
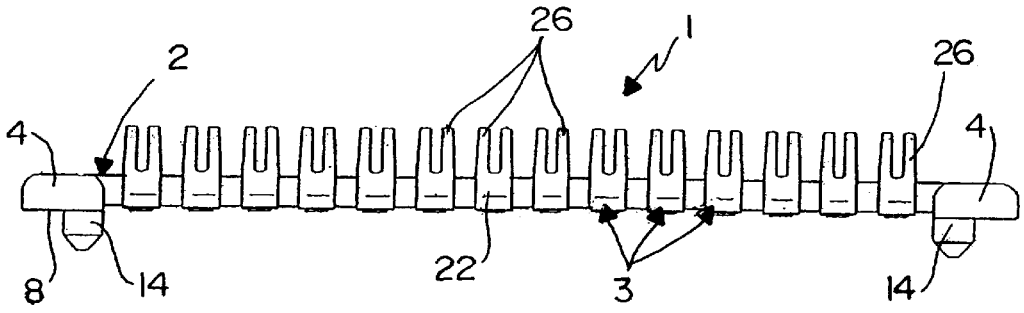
FIG. 3 is a front elevational view of the connector.
Figure 4:
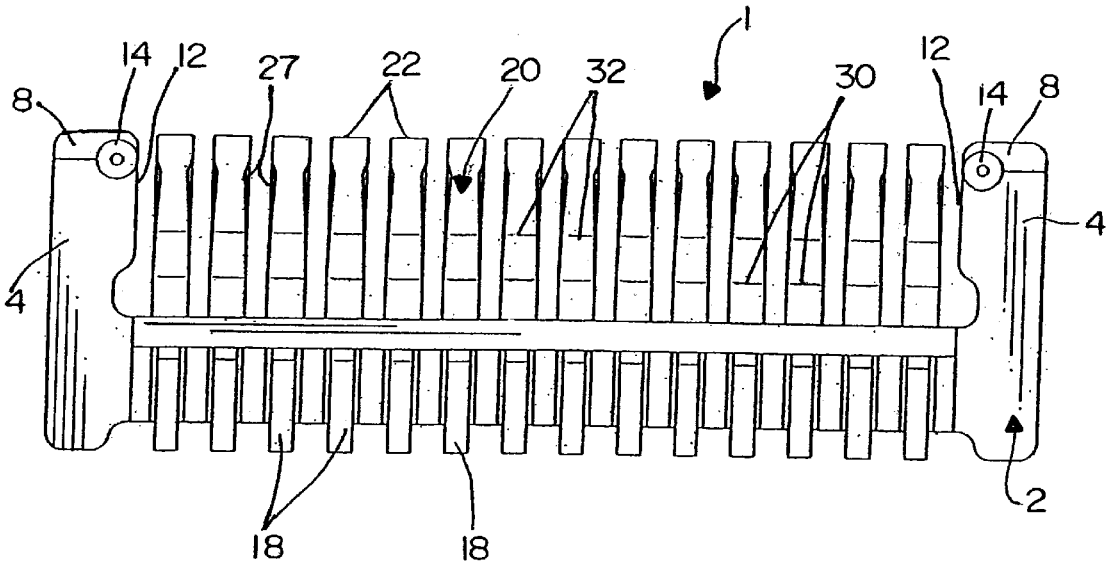
FIG. 4 is a bottom plan view of the connector.
Figure 5:
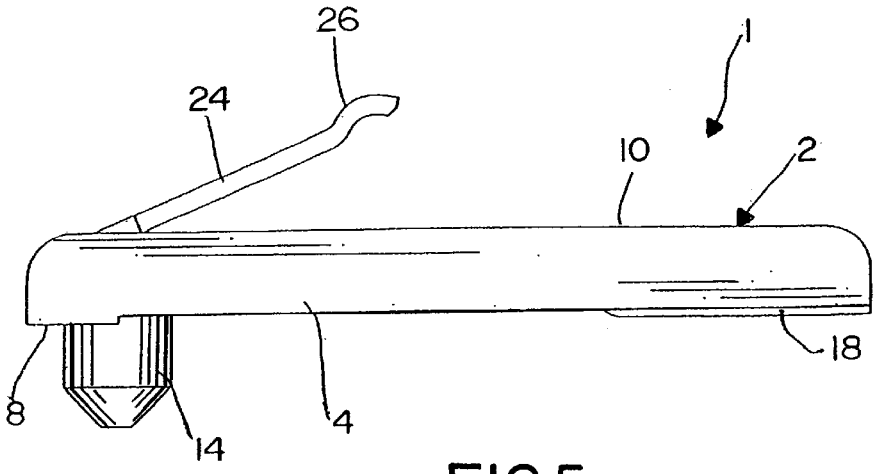
FIG. 5 is an end elevational view of the connector.

Referring to the drawings in greater detail, and first to FIGS. 1–5, the invention is embodied in an electrical connector, generally designated 1, which includes a generally flat dielectric housing, generally designated 2, which is adapted for mounting on a first flat circuit as will be described hereinafter in relation to FIG. 6. The housing mounts a plurality of terminals, generally designated 3, which are spaced along the housing as best seen in FIGS. 2, 3 and 4.

Housing 2 of connector 1 is a one-piece structure unitarily molded of dielectric material such as plastic or the like. The housing is thin or wafer-like and has a generally U-shaped configuration as seen best in FIGS. 2 and 4, as defined by a pair of spaced wing portions 4 joined by a cross portion 6. The housing defines a bottom surface 8 and a top surface 10 as best seen in FIGS. 1, 2, 4 and 5. Finally, wings 4 and cross portion 6 of housing 2 define an open area 12 (FIGS. 2 and 4) into which the contact portions of terminals 3 project as will be described in greater detail hereinafter. Finally, the housing includes a pair of mounting posts 14 for insertion into appropriate mounting holes in one of the flat circuits, as seen in FIG. 6.

Each terminal 3 includes a base 16 (FIG. 1) anchored within cross portion 6 of housing 2, as by insert molding the base in the molded plastic housing. A tail 18 extends from base 16 rearwardly of the connector. The bottom surface of the tail is coplanar with bottom surface 8 of the housing. The tail is provided for connection to an appropriate conductor or circuit trace of the flat circuit on which the connector is mounted. A cantilevered beam, generally designated 20, extends forwardly of base 16 into open area 12 of the housing and terminates in a U-shaped joint 22. A contact arm 24 extends from the U-shaped joint back over cantilevered beam 20 and terminates in a contact portion 26 for engaging an appropriate conductor on a second flat circuit, as will be described hereinafter in relation to FIG. 6. The cantilevered beam is narrowed, as at 27 (FIG. 4), inwardly of U-shaped joint 22. Contact portion 26 of each terminal is bifurcated, as seen best in FIGS. 2 and 3, to provide two points of contact for each terminal. The bottom-most point 28 (FIG. 1) of the U-shaped contact portion of the terminal is above bottom surface 8 of housing 2.

Figure 1:
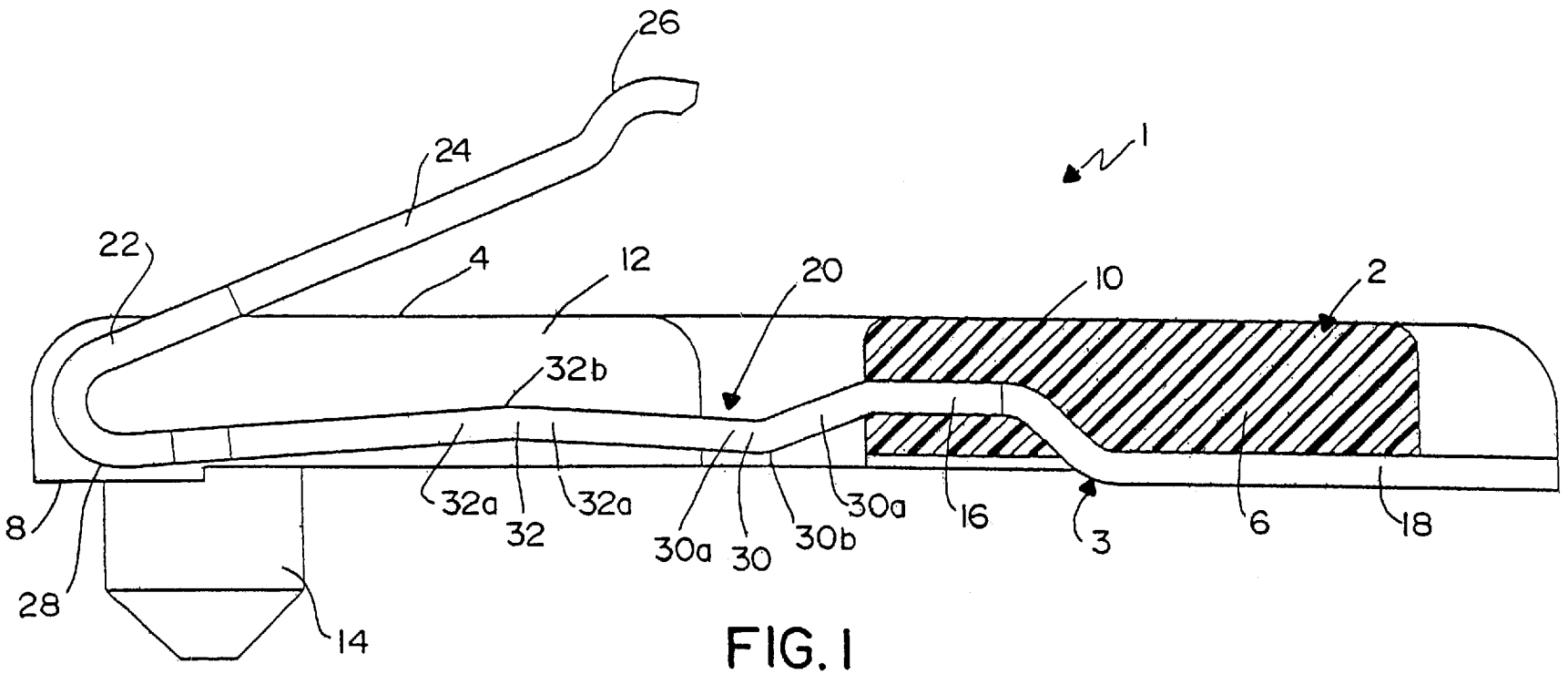
FIG. 1 is a front-to-rear section through an electrical connector embodying the concepts of the invention.

The invention contemplates that cantilevered beam 20 of each terminal 3 includes a first bowed portion 30 projecting downwardly toward the first flat circuit on which the connector is mounted, as clearly seen in FIG. 1, along with a second bowed portion 32 which projects upwardly toward the second flat circuit which engages contact portion 26 of contact arm 24 of the terminal. It can be seen in FIG. 1 that each bowed portion 30 and 32 actually comprises straight lengths 30*a* and 32*a*, respectively, of cantilevered beam 20 meeting at apexes 30*b* and 32*b*, respectively.

Figure 6:
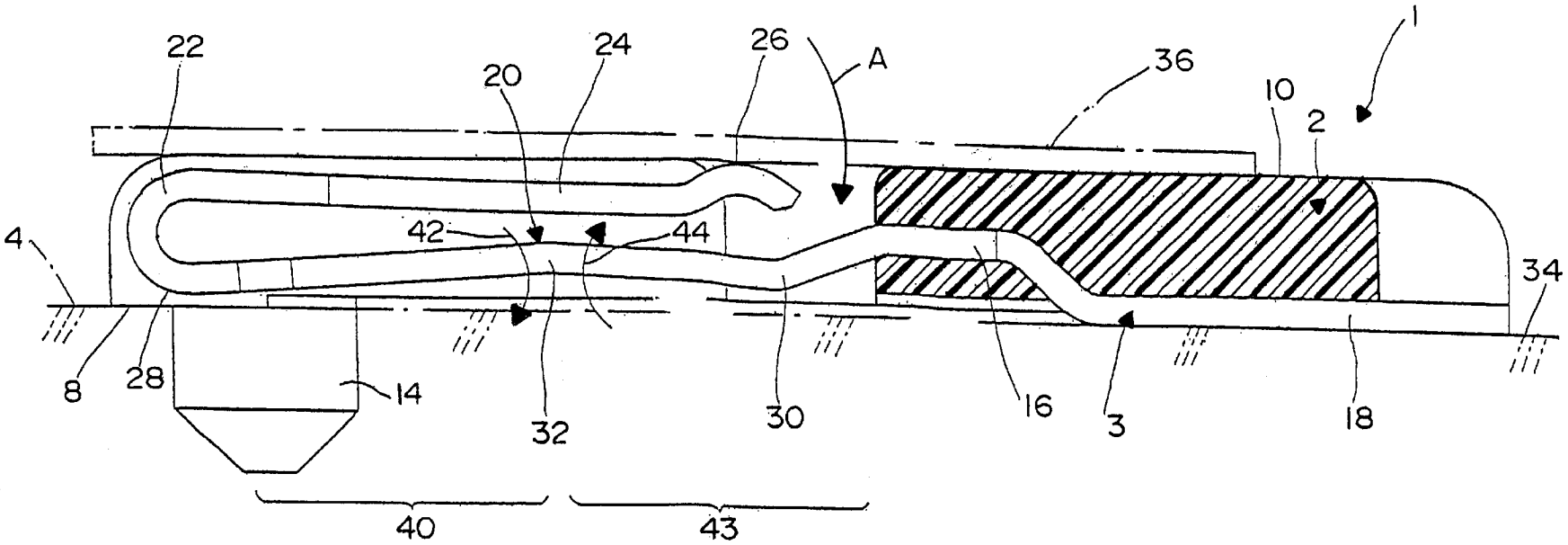
FIG. 6 is a view similar to that of FIG. 1, with the connector coupled between a pair of generally parallel flat circuits.

FIG. 6 shows connector 1 mounted on a first flat circuit 34 which may be a printed circuit board, for instance. It can be seen that bottom surface 8 of housing 2 and the bottom surfaces of tails 18 of terminals 3 are coplanar and engage the top surface of flat circuit 34. Tails 18 typically are connected, as by soldering, to appropriate circuit traces or conductors on the top surface of flat circuit 34.

FIG. 6 also shows a second flat circuit 36 engaged with contact portion 26 of contact arm 24 of each terminal to bias the contact arm downwardly in the direction of arrow "A" about U-shaped joint 22. Second flat circuit 36 could be a second printed circuit board, a flat flexible cable or the like.

It can be understood by comparing FIG. 1 with FIG. 6, that contact arm 24 flexes in the direction of arrow "A" (FIG. 6) a significant amount versus the minimal flexing of cantilevered beam 20. This phenomenon is caused by the stiffening of the cantilevered beam by upwardly and downwardly bowed portions 30 and 32, respectively, of the cantilevered beam.

More particularly, when contact arm 24 of each terminal 3 is pressed downwardly in the direction of arrow "A", to compress U-shaped joint 22, the moment of rotation will appear in the forward length 40 (FIG. 6) between joint 22 and upwardly bowed portion 32, as indicated by arrow 42. This moment of rotation, however, will be countered by the stiffening provided by upwardly projecting bowed portion 32 of the cantilevered beam, plus the resilience appearing in a rearward length 43 of the beam between bowed portion 32 and the rigid base 16 of the terminals, as indicated by arrow 44, along with a stiffening provided by downwardly bowed portion 30. In essence the configuration of rearward section43 of beam 20 counters the moment of rotation of forward section 40. Thus, an equilibrium can be established in cantilevered beam 20 and the stresses are more uniformly distributed therealong. In addition, the lower-most point 28 of the projecting contact portion of the terminal remains above bottom surface 8 of the housing notwithstanding the considerable movement of contact arm 24.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector foe interconnecting a pair of generally parallel flat circuits, comprising:

a generally flat molded dielectric housing adapter for mounting on a first flat circuit; and a plurality of terminals mounted on the housing and spaced there along, each said terminal including a base insert molded in the housing, a tail extending from one end of the base for connection to an appropriate conductor on said first flat circuit, a flexible cantilevered beam extending form an opposite end of the base and terminating in a U-shaped joint, a contact arm extending form the u-shaped joint back over the cantilevered beam and terminating in a contact portion for engaging an appropriate conductor on a second flat circuit, and said cantilevered beam including a first bowed portion nearer said base and projecting toward the first flat circuit and a second bowed portion nearer said U-shaped joint and projecting toward the second flat circuit, each bowed portion comprising straight lengths of the cantilevered beam meeting at an apex;

wherein when said contact arm is pressed downwardly to compress the U-shaped joint, a moment of rotation will appearing in a forward length between the U-shaped joint and the second bowed portion, said moment of rotation will be countered by a stiffening of the second bowed portion and by resilience appearing in a rearward length of a beam between said second bowed portion and the base and the stiffening provided by the first bowed portion.

2. The electrical connector of claim 1 wherein at least the bases of the terminals are insert molded in the housing.

3. The electrical connector of claim 1 wherein said second bowed portion follows the first bowed portion sequentially along the cantilevered beam away from the base toward the U-shaped joint of the terminal.

* * * * *